US006219882B1

(12) United States Patent
Olson

(10) Patent No.: US 6,219,882 B1
(45) Date of Patent: Apr. 24, 2001

(54) GLIDE ASSEMBLY

(75) Inventor: William J. Olson, Barrington, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/132,110

(22) Filed: Aug. 11, 1998

(51) Int. Cl.[7] ..... A47B 91/06; A47B 91/00
(52) U.S. Cl. ..... 16/42 R; 248/346.11
(58) Field of Search ..... 16/30, 43, 42 R, 16/42 T; 248/346.11; 403/70, 71, 119, 122

(56) References Cited

U.S. PATENT DOCUMENTS 3,722,026 * 3/1973 Wilhelmi ..... 16/42
5,010,621 * 4/1991 Bock ..... 16/42 T
5,042,764 * 8/1991 Carpinella et al. ..... 248/346.11
5,611,635 * 3/1997 Schutte et al. ..... 403/122
5,882,137 * 3/1999 Epp et al. ..... 403/122
5,991,974 * 11/1999 Carpinella ..... 16/42 R

* cited by examiner

*Primary Examiner*—Anthony Knight
*Assistant Examiner*—Vishal Patel
(74) *Attorney, Agent, or Firm*—Pitney, Hardin, Kipp & Szuch LLP

(57) ABSTRACT

The glide assembly is constructed with a shell which includes a circumferential flange which is crimped around a base which further includes an impact pad therewithin. The shell further includes the male portion of a ball joint with a relatively small aperture at a central portion thereof. A ferrule includes a cup shaped portion for receiving a furniture leg. The base of the ferrule includes the female portion of a ball joint with a relatively large aperture at a central portion thereof. A rivet swivelably attaches the male portion of the ball joint from the shell to the female portion of the ball from the ferrule. A washer/retainer engaged by the rivet accommodates the relatively large aperture of the ferrule while maintaining the swivel relationship. The cup of the ferrule engages an inside-holding or an outside-holding clip for engaging the leg of a piece of furniture.

16 Claims, 5 Drawing Sheets

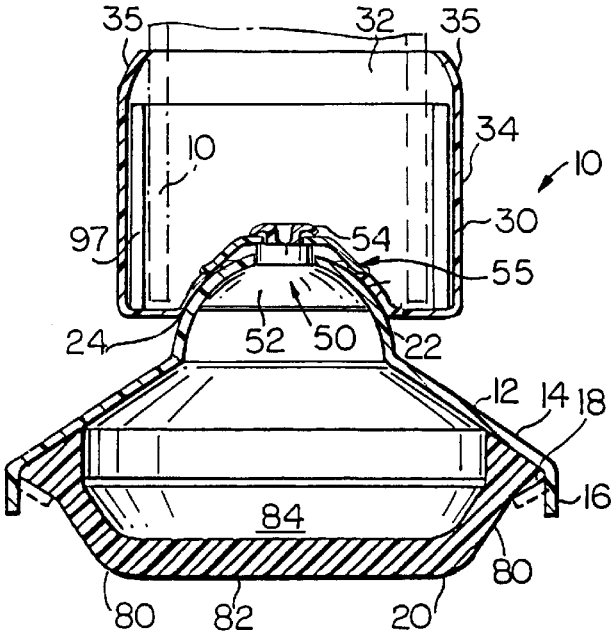
FIG. 13
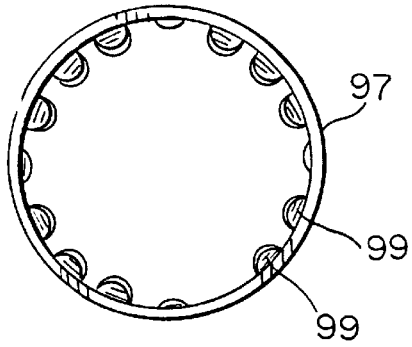
FIG. 15
FIG. 16
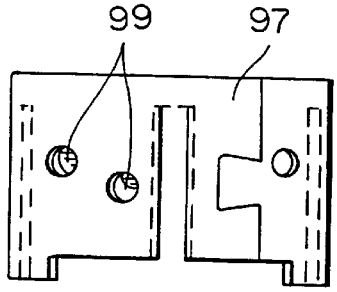
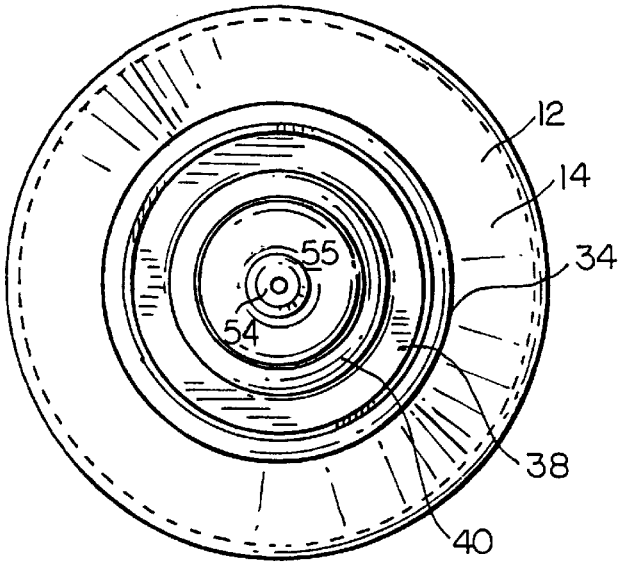
FIG. 14
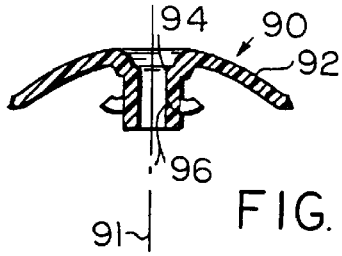
FIG. 17
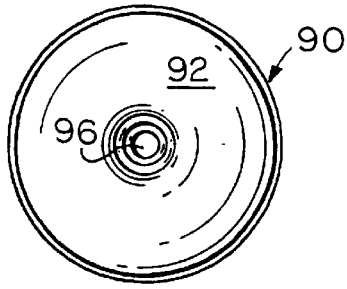
FIG. 18

GLIDE ASSEMBLY

BACKGROUND OF THE INVENTION

1. Field of the Invention

This invention pertains to a glide assembly for use with the leg of piece of furniture, such as, for example, a chair, desk or a stool.

2. Description of the Prior Art

Glides are used upon legs of furniture to provide a wearing and sliding surface for the furniture, and for decorative considerations. Hollow tubular legs extending from a chair or table are specific examples of furniture legs and the glide is mounted upon the leg end so as to contact the floor. The glide provides a smooth wearing surface for the furniture leg thereby avoiding abrasive sliding by the relatively rough or sharp tube end. Glides are provided both as inside gripping and outside gripping with respect to the typically hollow tubular legs of the furniture.

Glides should have the ability to swivel or change the angle of inclination of the floor-engaging surface with respect to the furniture leg (that is, two degrees of freedom of movement, typically plus or minus 15 degrees) in order to present a level surface to the floor when the furniture leg tilts. Similarly, glides should have the ability to absorb impact as would be expected during the lifetime of the piece of furniture. It is important, however, to maintain sturdy construction and low manufacturing costs. Low manufacturing costs can typically be achieved by a design with a reduced number of parts.

An example of a prior art glide which is inner gripping is disclosed in U.S. Pat. No. 5,010,621 entitled "Glide Assembly with Inside Holding Clip", issued on Apr. 30, 1991 to Bock and assigned to the present assignee of this application. This prior art glide assembly is inner-gripping with an outer sleeve for mounting upon the end of tubular member. The glide further has an interior upright pedestal with outwardly extending gripping prongs for insertion into the tubular member.

OBJECTS AND SUMMARY OF THE INVENTION

It is therefore an object of the present invention to provide a glide which engages a tubular member, such as the leg of a chair, table or similar piece of furniture.

It is therefore a further object of the present invention to provide a glide with the ability to change the inclination of the floor engaging surface with respect to the furniture leg.

It is therefore a still further object of the present invention to provide a glide which can absorb impact during the expected life of the piece of furniture.

It is therefore a still further object of the present invention to provide a glide which includes a reduced number of components in order to reduce manufacturing costs.

These and other objects are attained by providing a glide which includes a circumferential flange that is shaped to spread evenly the loads into the shell. The varying thickness of the bottom and side walls connecting to the flange are designed to flex slightly to attenuate the impact loads as they are transferred to the shell. The glide also has a lip under the flange that allows the shell to be crimped around the glide with less stress induced into the glide while securely holding the glide. The shell design allows an increased crimp angle around the glide to hold it securely without excessively stressing the glide. The male portion of the pivot joint ball is incorporated into the shell. A rivet and a washer/retainer are designed to hold the shell securely to the ferrule while allowing the shell to swivel freely through the full range of plus or minus fifteen degrees.

The ferrule has a female portion of the ball joint stamped into its base to receive the ball portion of the shell. This provides a large surface area joint to transfer the loads from the glide to the leg with minimal stresses induced in either the ferrule or the shell. There is a large hole in the bottom of the ball to allow the rivet and shell space to swivel through the required range. The present invention can include an inside-holding or an outside-holding clip within the ferrule.

The inside-holding clip is pushed into the ferrule and includes upwardly pointing barbs on the three lower legs of the clip to engage the interior of the furniture leg and to resist being pulled back out. These three legs of the clip additionally are used to transfer the loads from the glide to the furniture leg. The inside-holding clip further includes three upwardly extending arms at a somewhat reduced radius with downwardly pointing barbs to engage the inside of the hollow tubular leg of the piece of furniture. The outside-holding clip includes circumferential ring to engage the outside of the furniture leg. An inwardly sloped flange is formed on the top of the ferrule to hide the outside-holding clip.

BRIEF DESCRIPTION OF THE DRAWINGS

Further objects and advantages of the invention will become apparent from the following description and claims, and from the accompanying drawings, wherein:

FIG. 13 is a side cross-sectional view of the outside-holding embodiment of the present invention, with the leg of the furniture piece shown in phantom.

FIG. 14 is a top plan view of the outside-holding embodiment of the present invention.

FIG. 15 is a top plan view of the clip of the outside-holding embodiment of the present invention.

FIG. 16 is a side plan view of the clip of the outside-holding embodiment of the present invention.

FIG. 17 is a side cross-sectional view of an alternative embodiment of the rivet of the present invention.

FIG. 18 is a top plan view of an alternative embodiment of the rivet of the present invention.

DETAILED DESCRIPTION OF THE PREFERRED EMBODIMENTS

Figure 1:
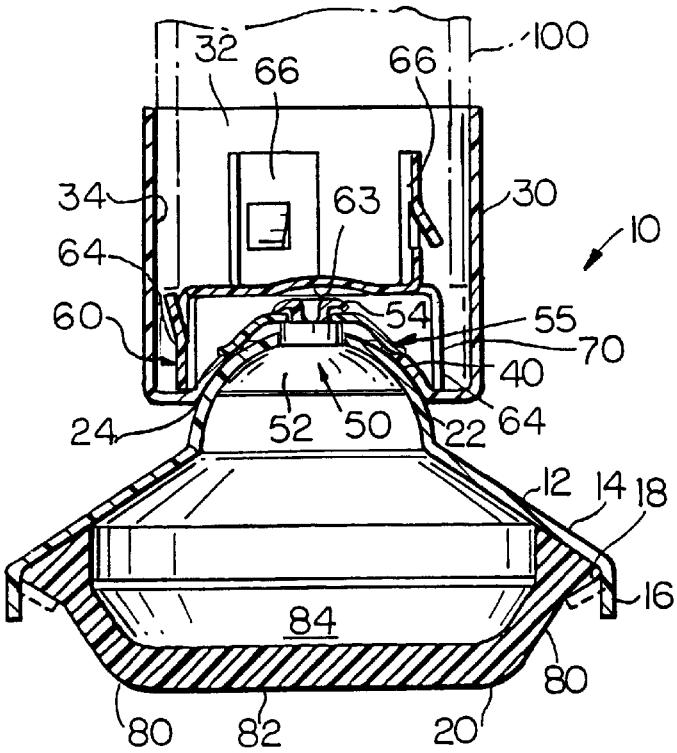
FIG. 1 is a side cross-sectional view of the inside-holding embodiment of the present invention, with the leg of the furniture piece shown in phantom.
Figure 2:
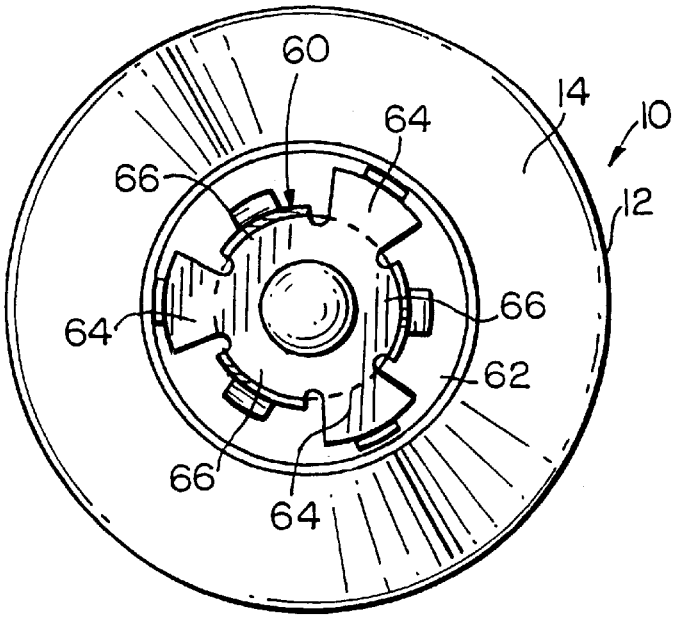
FIG. 2 is a top plan view, partly in phantom, of the inside-holding embodiment of the present invention.

Referring now to the drawings in detail wherein like numerals refer to like elements throughout the several views, one sees that FIG. 1 is a cross-sectional view of the inside-holding embodiment of the glide assembly 10 of the present invention and, similarly, FIG. 2 is a top view of the inside-holding embodiment of the glide assembly 10 of the present invention.

Figure 3:
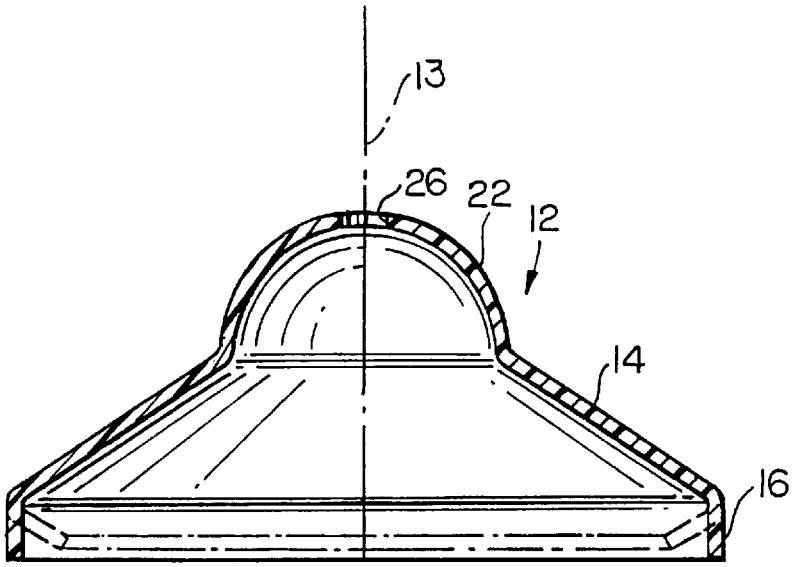
FIG. 3 is a side cross-sectional view, partly in phantom, of the outer shell of the present invention.
Figure 4:
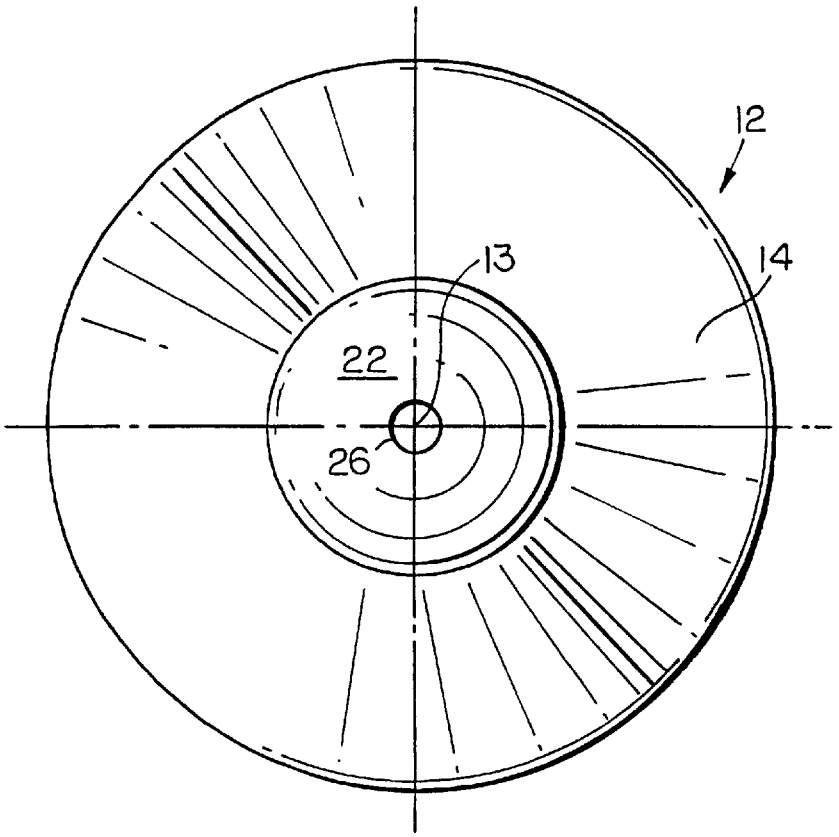
FIG. 4 is a top plan view of the outer shell of the present invention.

Glide assembly 10 includes a shell 12 which is shown in more detail in FIGS. 3 and 4. Shell 12 is rotationally symmetric about axis 13 (see FIG. 3) and includes an inclined circumferential flange 14. The outer portion of inclined circumferential flange 14 includes circumferential lip 16 which is crimped to engage the outer circumferential bevel 18 of base 20. Circumferential lip 16 is illustrated in solid lines in FIGS. 1 and 3 in the uncrimped position and in phantom in the crimped position engaging the outer circumferential bevel 18 of glide assembly 10. Shell 12 further includes at the interior thereof the partially hemispherically shaped male portion 22 of ball joint 24. The uppermost portion of partially hemispherically shaped male portion 22 includes aperture 26 centered on axis 13. Base 20 is typically made of nylon and includes inclined walls 80 which descend from circumferential bevel 18 to lower planar surface 82 which is designed to engage the floor (not shown). The interior of base 20 can include impact pad 84 to absorb energy and to assist in the even distribution of the energy about circumferential flange 14 of shell 12.

Figure 5:
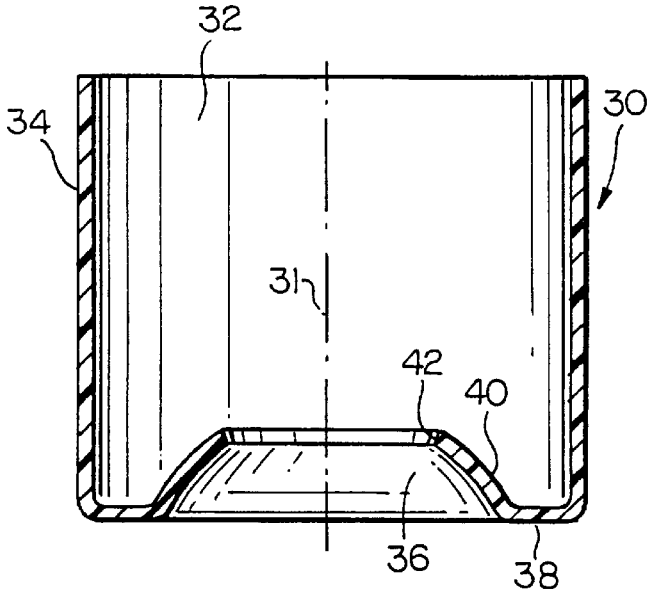
FIG. 5 is a side cross-sectional view of the ferrule of the present invention.
Figure 6:
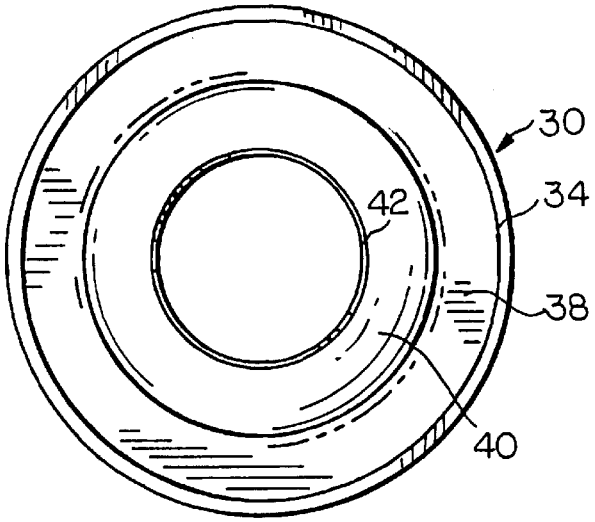
FIG. 6 is a top plan view of the ferrule of the present invention.

Glide assembly 10 further includes ferrule 30 which is illustrated in detail in FIGS. 5 and 6. Ferrule 30 is rotationally symmetric about axis 31. Ferrule 30 includes cup portion 32 formed from upwardly directed cylindrical walls 34. The leg of the furniture piece 100 is inserted into cup portion 32. The floor 36 of ferrule 30 includes outer horizontal portion 38 which is perpendicular to upwardly directed cylindrical walls 34. Immediately inward from outer horizontal portion 38 is partially hemispherically shaped female portion 40 of ball joint 24. The upper portion of partially hemispherically shaped female portion 40 includes large aperture 42. As will be described in more detail hereinafter, large aperture 42 of ferrule 30 is larger than aperture 26 of shell 12 in order to allow shell 12 and ferrule 30 to swivel with respect to each other. This incorporation of the ball joint 24 into portions of shell 12 and ferrule 30 provides for the elimination of the separate ball joint elements of the prior art thereby reducing manufacturing costs while maintaining a large surface area joint to transfer the loads from the glide assembly 10 to the leg of the furniture piece 100 with minimal stresses induced in either the ferrule 30 or the shell 12.

Figure 7:
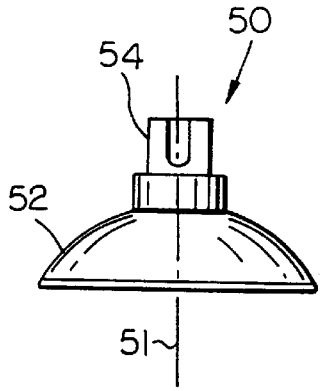
FIG. 7 is a side plan view of the rivet of the present invention.
Figure 8:
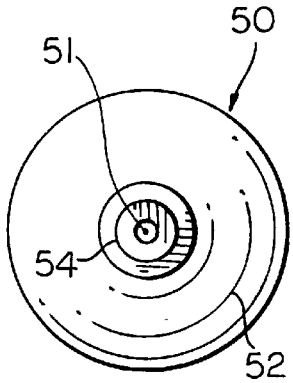
FIG. 8 is a top plan view of the rivet of the present invention.

FIGS. 7 and 8 illustrate rivet 50 which passes through apertures 26 and 42 to engage washer/retainer 55 (see FIGS. 9 and 10) thereby holding ferrule 30 to shell 12 and providing a swivel arrangement therebetween. Rivet 50 is rotationally symmetric about axis 51. Rivet 50 includes lower dome 52 which engages underneath the interior portion of partially hemispherically shaped male portion 22 of ball joint 24 and is of complementary curvature thereto. Rivet 50 further includes upper crimping portion 54 which extends upwardly through large aperture 42 of ferrule 30 and central aperture 59 of washer/retainer 55 (see FIGS. 9 and 10).

Figure 9:
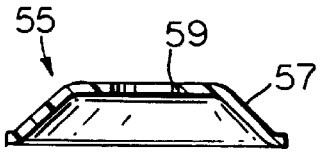
FIG. 9 is a side plan view, partially in cross section, of the washer/retainer of the present invention.
Figure 10:
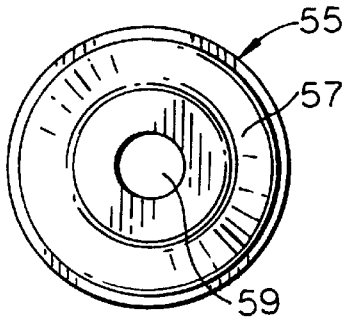
FIG. 10 is a top plan view of the washer/retainer of the present invention.

Washer/retainer 55 is illustrated in FIGS. 9 and 10. Washer/retainer 55 includes central aperture 59 and downwardly extending rotationally symmetric walls 57. As shown in FIG. 1, downwardly extending rotationally symmetric walls 57 are shaped to engage the upper portion of partially hemispherically shaped female portion 40 of ball joint 24. However, downwardly extending rotationally symmetric walls 57 are preferably less curved than partially hemispherically shaped female portion 40 and the cross section may have portions that approach linearity. Further, the outer periphery of downwardly extending rotationally symmetric walls 57 include outwardly flared lip 61. This configuration minimizes or eliminates binding of washer/retainer 55 while swiveling about partially hemispherically shaped female portion 40 of ball joint 24.

Washer/retainer 55 as retained by rivet 50 has sufficient spring clamping action to hold shell 12 tightly to ferrule 30 while allowing full swiveling movement with aperture 42 of ferrule 30 throughout the required range of substantially plus or minus fifteen degrees.

FIGS. 17 and 18 illustrate rivet 90 which can be substituted for the combination of rivet 50 and washer/retainer 55. Rivet 90 is rotationally symmetric about axis 91 and includes upper domed flange 92 which engages partially hemispherically shaped female portion 40 of ball joint 24 and is of complementary curvature thereto. Upper domed flange 92 has sufficient spring clamping action to hold shell 12 tightly to ferrule 30 while allowing full swiveling movement throughout the required range of substantially plus or minus fifteen degrees. Aperture 94 is formed at a central location in rivet 90. Walls 96 of aperture 94 form a rivet portion to engage aperture 26 of shell 12. Walls 96 forming the rivet portion are illustrated in the unriveted or uncrimped position in solid lines and in the riveted or crimped position in phantom in FIG. 17.

Figure 11:
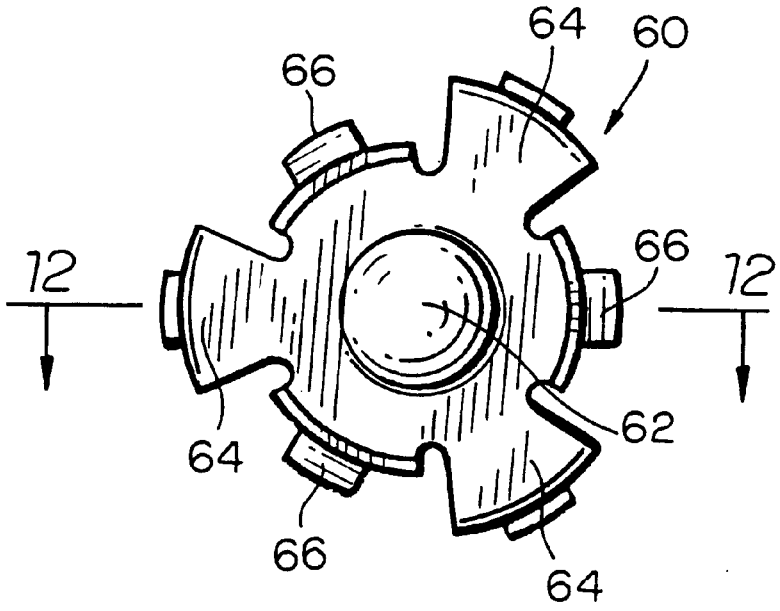
FIG. 11 is a top plan view of the clip of the inside-holding embodiment of the present invention.
Figure 12:
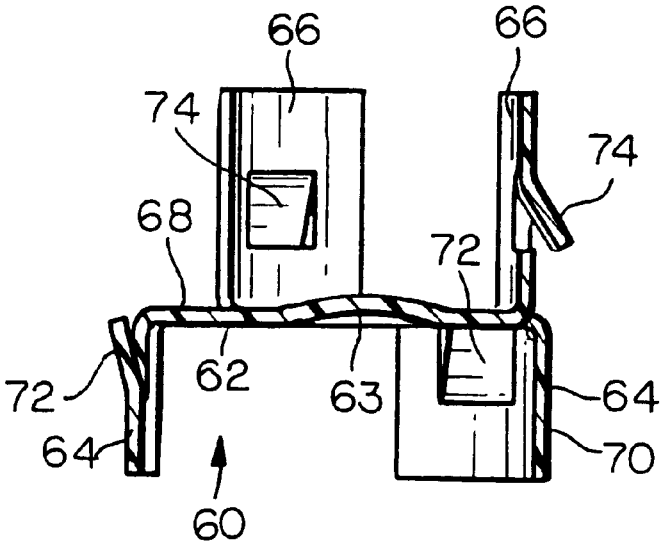
FIG. 12 is a side cross-sectional view of the clip of the inside-holding embodiment of the present invention along plane 12—12.

Inside-holding clip 60 is illustrated in FIGS. 11 and 12. Inside-holding clip 60 includes a central circular support section 62 which further includes a slightly upwardly bowed interior portion 63 to accommodate the shape of rivet 50 and washer/retainer 55. Three downwardly extending legs 64 and three upwardly extending arms 66 alternate around the circumference of central circular support section 62. Downwardly extending legs 64 include a generally horizontal outwardly extending portions 68 which are sized to extend to the interior of cylindrical walls 34 of cup section 32 of ferrule 30 into which inside-holding clip 60 is inserted. Downwardly extending legs 64 further include downwardly extending portions 70 which grip the interior of cylindrical walls 34 of cup section 32 of ferrule 30 into which inside-holding clip 60 is inserted. Downwardly extending portions 70 of downwardly extending legs 64 further include upwardly and slightly outwardly extending barbs 72 cut from the material of downwardly extending portions 70 in order to increase the resistance to inside-holding clip 60 being pulled from ferrule 30 without substantially increasing the resistance to the initial insertion of inside-holding clip 60 into ferrule 30.

Arms 66 extend upwardly at a radius somewhat recessed from that of legs 64 for engaging the interior of a hollow tubular leg of the furniture piece 100 and further include downwardly and slightly outwardly extending barbs 74 cut from the material of upwardly extending arms 66 in order to increase the resistance to furniture leg 100 being pulled from inside-holding clip 60 and ferrule 30 without substantially increasing the resistance to the initial insertion of furniture leg 100 into inside-holding clip 60 and ferrule 30.

FIGS. 13–16 relate to an embodiment of glide assembly 10 which engages the outside of the leg of furniture 100 rather than the inside. FIG. 13 includes substantially the same base 20, impact pad 84, shell 12, rivet 50 and retainer/washer 55 of the inside-holding embodiment of FIGS. 1–12. The ring-shaped outside-holding clip 97 replaces the inside-holding clip 60 and is placed immediately inwardly adjacent of walls 34 of ferrule 30. Outside-holding clip 97 includes inwardly extending tooth-like protrusions 99 cut from the material of clip 97 and used to engage securely the outside of a tubular furniture leg 100. Ferrule 30 includes walls 34 which include an upper inwardly sloped flange portion 35 to securely hold outside-holding clip 97 therewithin and further to aesthetically conceal clip 97 from view.

To assemble the glide assembly 10 of the present invention, typically impact pad 84 is inserted into base 80 and circumferential lip 16 of circumferential flange 14 of shell 12 is crimped around bevel 18 of base 80. Rivet 50 and washer/retainer 55 (or rivet 90 of FIGS. 17 and 18) are then used to secure ferrule 30 to shell 12. Inside-holding clip 60 or outside-holding clip 97 is inserted into cylindrical walls 34 of ferrule 30. If outside-holding clip 97 is used, upper inwardly sloped flange portion 35 could be formed after the insertion of outside-holding clip 97 into ferrule 30.

To attach glide assembly 10 to a piece of furniture, glide assembly 10 is typically pushed onto the end of the leg of the piece of furniture, with the inside-holding clip 60 or outside-holding clip 97 in its respective appropriate position.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A glide assembly including:

a shell including a circumferential flange portion radially outwardly adjacent from an interior integral first portion, said first portion including a first at least partially hemispherical shape;

a ferrule including a cup section and a lower base with an interior second portion, said second portion including a second at least partially hemispherical shape, said first and second at least partially hemispherical shapes being complementary to each other and forming a ball joint arrangement therebetween;

rivet means for passing through at least one of said first and second at least partially hemispherical shapes thereby securing said first portion to said second portion while allowing said first portion to swivel with respect to said second portion; and means within said cup section for engaging a tubular leg of a piece of furniture.

2. The glide assembly of claim 1 further including a base section secured to said circumferential flange portion.

3. The glide assembly of claim 2 wherein one of said first portion and said second portion is a male element and another of said first portion and said second portion is a female element.

4. The glide assembly of claim 3 wherein said first portion includes a first aperture and said second portion includes a second aperture and wherein said rivet means engages said first portion to said second portion by passing through said first aperture and said second aperture.

5. The glide assembly of claim 4 wherein one of said first aperture and said second aperture is larger than the other, wherein said rivet means is relatively movable with respect to a larger of said first aperture and said second aperture and is relatively fixed with respect to a smaller of said first aperture and said second aperture.

6. The glide assembly of claim 5 wherein said rivet means includes a rivet which engages a retainer, said retainer covering a larger of said first aperture and said second aperture.

7. The glide assembly of claim 6 wherein said retainer includes downwardly extending rotationally symmetric walls formed about a central aperture, said central aperture being engaged by said retainer and said downwardly extending rotationally symmetric walls engaging said interior second portion of said ferrule.

8. The glide assembly of claim 7 wherein said rivet includes a lower dome portion for engaging an interior lower portion of said first portion of said shell.

9. The glide assembly of claim 8 wherein said means for engaging a tubular leg includes a clip with downwardly extending legs for engaging said cup section of said ferrule and upwardly extending arms for engaging an interior of a hollow tubular leg of a piece of furniture.

10. The glide assembly of claim 9 wherein said clip includes a base section and wherein said downwardly extending legs and said upwardly extending arms alternate around a periphery of said base section.

11. The glide assembly of claim 10 wherein said downwardly extending legs include upwardly extending barbs cut from material thereof.

12. The glide assembly of claim 11 wherein said upwardly extending legs include downwardly extending barbs cut from material thereof.

13. The glide assembly of claim 8 wherein said means for engaging a tubular leg includes a ring-shaped clip with inwardly extending protrusions for engaging an exterior of a tubular leg of a piece of furniture.

14. The glide assembly of claim 13 wherein a top of said cup section includes inwardly sloped flange portions to hold said ring-shaped clip within said cup portion.

15. The glide assembly of claim 5 wherein said rivet means includes a domed portion which covers a larger of said first aperture and said second aperture.

16. The glide assembly of claim 15 which said rivet means further includes a crimp portion which engages a smaller of said first aperture and said second aperture.

* * * * *